United States Patent [19]

Kawamata

[11] 4,004,410

[45] Jan. 25, 1977

[54] FLUID-TIGHT WATCHCASE AND IMPROVED RING GASKET FOR THE SAME

[75] Inventor: Toshiaki Kawamata, Matsudo, Japan

[73] Assignee: Kabushiki Kaisha Daini Seikosha, Japan

[22] Filed: Dec. 14, 1973

[21] Appl. No.: 424,856

[30] Foreign Application Priority Data

Dec. 16, 1972 Japan ..... 47-144521

[52] U.S. Cl. ..... 58/90 R

[51] Int. Cl.[2] ..... G04B 37/08

[58] Field of Search ..... 58/90 R

[56] References Cited

UNITED STATES PATENTS 2,708,338 5/1955 Pfisterer ..... 58/90 R

FOREIGN PATENTS OR APPLICATIONS 215,176 6/1941 Switzerland ..... 58/90 R

*Primary Examiner*—George H. Miller, Jr.

*Attorney, Agent, or Firm*—Robert E. Burns; Emmanuel J. Lobato; Bruce L. Adams

[57] ABSTRACT

A waterproof watchcase having an improved tight gasket for effecting a watertight seal with a watch crystal or bezel and a watchcase. The improved gasket comprises an inner ring gasket made of elastic, deformable material for effecting a seal without adhesive and an auxiliary ring comprising an outer ring of a rigid material circumferentially of the inner ring for limiting the deformation outwardly of the inner ring. The outer ring is of lesser thickness than the inner ring. The inner ring has oppositely disposed surfaces which define the thickness dimension thereof and effect the sealing. The auxiliary ring may be a split ring in which case the elastic, deformable ring is clamped and held between the two rigid rings. The gasket rings all conform to the cross-section configuration of the watchcase and may be non-circular, rectangular or ellipsoidal and other shapes.

5 Claims, 12 Drawing Figures

FLUID-TIGHT WATCHCASE AND IMPROVED RING GASKET FOR THE SAME

BACKGROUND OF THE INVENTION

The present invention relates generally to watchcases and more particularly to a new and improved ring gasket for complicated configurations of watchcases.

Conventional non-circular watchcases have been provided with gasket seals in which the gasket is confined by the structure being sealed. For example the gasket effecting a fluid-tight seal with a watch crystal requires that the gasket be confined by portions of the watch crystal. The same is true for watchglass rings or bezels. This necessarily requires a more complex structure of the elements with which the gasket cooperates.

Moreover, gaskets used for defining an access opening into the watchworks internally of the waterproof watch have generally been deformed by the elements cooperating therewith. This generally has required a more complex assembly. For example, the dial becomes more complicated in shape.

SUMMARY OF THE INVENTION

It is a principal object of the present invention to provide a new and improved ring gasket for effecting watertight seals between the watch crystals and the watchcase band or between the crystal ring and the watchcase band.

Another object of the present invention is to provide a new and improved waterproof watchcase employing the ring gaskets according to the invention.

The ring gasket according to the invention is for providing a fluid-tight seal, without use of adhesive, between the gasket and the watch crystal and a watchcase band. These gaskets may likewise be provided for effecting a fluid-tight seal, without adhesive, between a bezel and a watchcase band. The gasket makes provision for the use of extensive compression of the gasket by having provided thereon an auxiliary ring made of a rigid material and disposed circumferentially of an inner ring made of an elastic, deformable material. The outer ring limits the deformation outwardly of the inner ring and is of lesser thickness so that the inner ring may be compressed extensively so that the opposite surfaces defining the thickness dimension effect a very tight waterproof seal.

One embodiment of the invention has the auxiliary ring split into an outer and innermost ring compressing the deformable ring between them. The cooperative rings are made of a non-circular configuration conforming to the configuration of the cross-section of the watchcase.

Provision is made by a gasket according to the invention for controlling the deformation of a ring elastic gasket along an arcuate length deformed by an arcuate member. The deformation provides an access opening interiorly of the watchcase for access to setting levers and the like.

Other objects and advantages will appear from the following description of an example of the invention, and the novel features will be particularly pointed out in the appended claims.

DESCRIPTION OF THE PREFERRED EMBODIMENTS

Figure 1A:
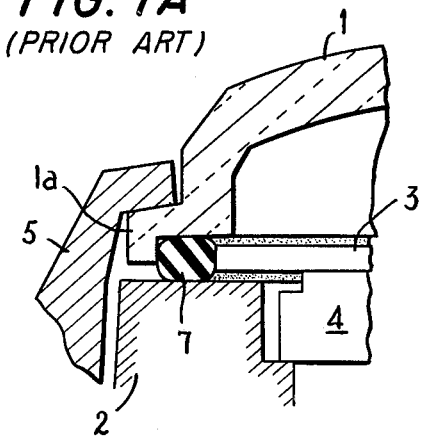
FIG. 1A (PRIOR ART)
FIG. 1A is a fragmentary cross-section view of a ring gasket seal according to the prior art.

Heretofore watertight seals between a watchglass or a crystal and a watchcase band or a seal between the watchcase band and a bezel has required that the elements sealed be constructed with means for confining the deformation of the elastic deformable ring gasket in order to allow for extensive compression or deformation of the gasket. This is particularly true in ring gaskets which are non-circular. Examples of the prior art of this type of construction, are illustrated in FIGS. 1A and 1B.

As shown in the drawings, a watch crystal 1 overlies an inner watchcase band 2 which supports a watch dial 3 and interiorly of which is disposed watchworks 4. An outer watchcase band 5 clamps the watch crystal 1 to deform an elastic ring gasket 7. The watch crystal 1 is provided with a circumferential flange **1*a* disposed circumferentially of ring gasket 7** to limit the outward deformation of the gasket.

Throughout the description, it will be understood that ring herein refers to complex configurations of annular members such as non-circular, ellipsoidal, rectangular and square rings.

Figure 1B:
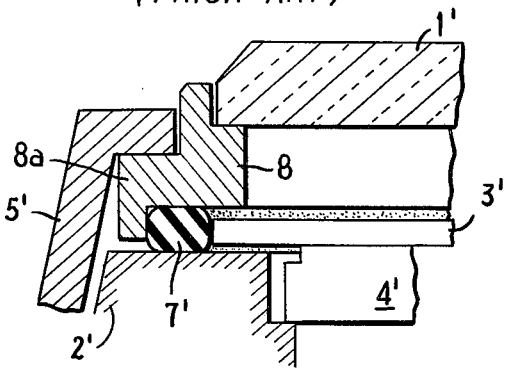
FIG. 1B (PRIOR ART)
FIG. 1B is a fragmentary cross-section view of a second embodiment of a ring gasket seal according to the prior art.

A second embodiment of a watchcase according to the prior art is illustrated in FIG. 1B in which a watch crystal 1' is supported on an inner watchcase band 2' which likewise supports a watch dial 3' and interiorly of which are disposed watchworks 4'. An outer watchcase band 5' is provided and a ring seal 7' effects a fluid-tight seal between a watchcase band and a bezel or watchglass ring 8. The bezel 8 is provided with a flange **8*a* circumferentially of the exterior of the ring gasket 7' to limit the outward deformation thereof when compressed to effect the waterproof seal between the bezel 8 and the watchcase band 2'**.

In watch constructions a ring gasket seals circumferentially of a watch dial in which case the dial may be provided with a notch providing an opening into the interior of the watch but a watertight seal must be maintained. A conventional member in which the access is provided is to provide a projection 3*a* on the watch dial 3 with a notch 3*b* to provide the access. The projection 3*a* bulges the ring gasket 7 outwardly and as a consequence the gasket 7 does not conform to the projection as can be seen in FIG. 2 so that voids are formed between the gasket and the dial, as illustrated in the drawing, which tend to reduce the fluid-tightness of the structure as would otherwise be the case if the ring 7 fitted snugly about the dial to improve the fluid-tightness of the seal.

Figure 2:
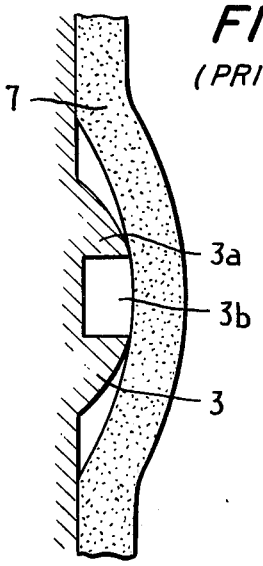
FIG. 2 (PRIOR ART)
FIG. 2 is a fragmentary cross-section view of a prior art ring gasket making provision for access interiorly of a watchcase band.
Figure 4:
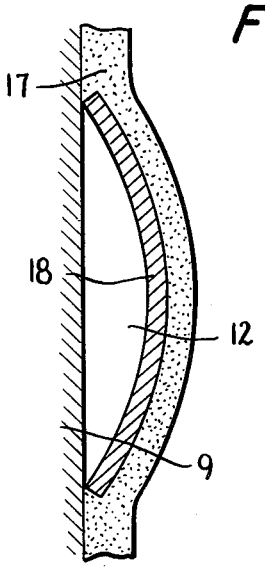
FIG. 4 is a fragmentary cross-section view of a ring gasket according to the invention.

In order to provide an access opening without the problem of the construction illustrated in FIG. 2, a watch dial 9 may, as shown in FIG. 4, define an access opening 12 in conjunction with an elastic, deformable ring gasket 17 according to the invention. The ring gasket has an auxiliary element 18 made of a rigid material which deforms the gasket 17, made of elastic deformable material, away from the watch dial 9 and allows a fluid-tight seal to be maintained about the watch dial 9.

Figure 3A:
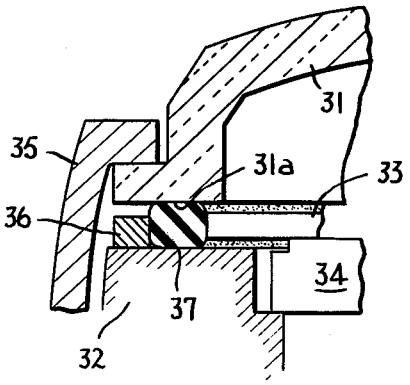
FIG. 3A is a fragmentary cross-section view of a ring gasket and watchcase according to the invention.

A watchcase provided with a ring gasket according to the invention is illustrated in FIG. 3A. As illustrated, a watch crystal or glass 31 is superimposed over an inner watchcase band 32 supporting a watch dial 33 and interiorly of which are disposed watchworks 34. An outer watchcase band 35 overlies a flange 31*a* of the watch crystal which is provided with a flat underside surface and effects a fluid-tight seal with a ring gasket 36, 37.

The ring gasket is a composite gasket made of an inner elastic deformable ring 37 which has oppositely disposed surfaces defining the thickness thereof and contacting the flat underside surface of the watch crystal and an equally flat upper surface of the watchcase band for effecting a fluid-tight seal therewith. The ring gasket further comprises an auxiliary ring 36 made of a rigid material and of lesser thickness than the inner ring 37 which precludes deformation outwardly of the inner ring 37 along its circumferential dimension by providing contact between lateral surfaces of the inner and auxiliary rings, as shown, so that a very substantial pressure can be applied to the inner ring gasket 37 to deform it to effect a fluid-tight seal between the watchcase band 32 and the dial 33. It will be noted that the use of this type of ring gasket eliminates the complex, shouldered watch structure crystal of the type construction illustrated in the prior art configuration in FIG. 1A. At the same time this construction fully precludes deformation along the length of the auxiliary ring or member 36.

Figure 3B:
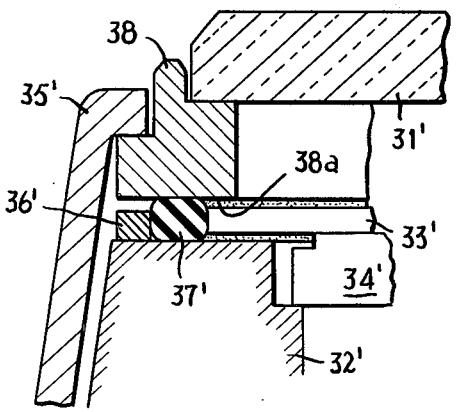
FIG. 3B is a fragmentary cross-section view of a watchcase and ring gasket according to the invention.

A second watchcase waterproofed according to the invention is illustrated in FIG. 3B. Therein a watch crystal 31′ is supported on an inner watchcase band 32′ likewise supporting a watch dial 33′ and interiorly of which are disposed watchworks 34′. An outer watchcase band 35′ is provided and a watertight seal is effected by a ring gasket 36′, 37′ seated on the inner watchcase band and compressed by a bezel 38 having a flat underside surface 38*a* clamping or compressing the deformable and elastic ring gasket 37′. The ring gasket comprises an outer rigid, undeformable ring 36′ circumferentially of the inner ring 37′ which is elastic and deformable and of greater thickness.

Figure 3C:
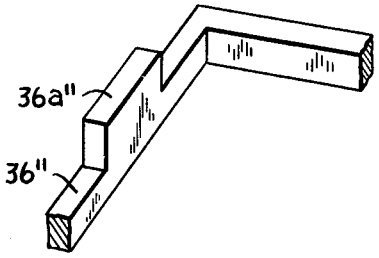
FIG. 3C is a fragmentary perspective view of an auxiliary ring for a ring gasket according to the invention.

The ring gaskets constituting an inner deformable ring and an outer rigid ring may be constructed with different types of cross-sections as later described herein. For example, a ring gasket of the types illustrated in FIGS. 3A and 3B can be constructed as a variation thereof in a manner illustrated in FIG. 3C. Therein an outer ring 36″ is disposed circumferentially of an inner ring not shown. The outer ring 36″ is provided with an upstanding projection 36*a*″. This upstanding projection can fit into a recess, not shown, provided in a watch crystal or a bezel overlying the ring gasket when in use. The cooperation of the projection with the overlying element eliminates relative movement therebetween.

Figure 5:
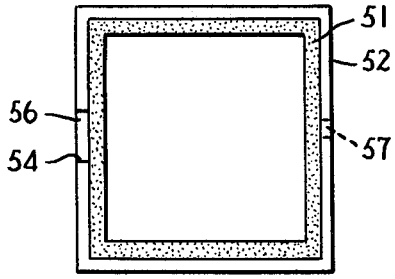
FIG. 5 is a plan view of a ring gasket according to the invention.
Figure 6:
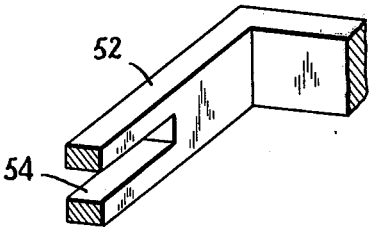
FIG. 6 is a fragmentary perspective view of an elastic ring gasket auxiliary ring according to the invention of the type in FIG. 5.

Another type of ring gasket according to the invention is illustrated in FIGS. 5 and 6. Therein an inner elastic deformable ring 51 is of square or rectangular configuration and is provided with an outer rigid ring 52 which has a slot 54 into which extends a projection 56 of the inner ring interlocking the two together. Another type of interlock may be provided through an opening in connection illustrated in broken lines at 57.

Figure 7:
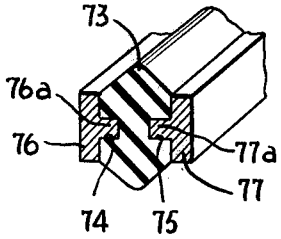
FIG. 7 is a fragmentary perspective view, partly in cross-section, of a ring gasket according to the invention.
Figure 8:
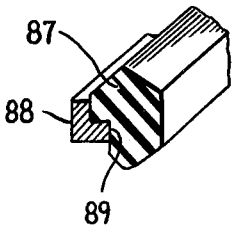
FIG. 8 is a fragmentary perspective view, partly in cross-section, of another embodiment of the ring gasket according to the invention.
Figure 9:
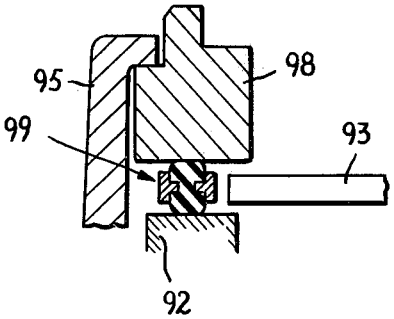
FIG. 9 is a fragmentary cross-section view of a watchcase provided with another embodiment of a ring gasket according to the invention.

While the ring gasket according to the invention has been described as being made of an inner elastic and deformable ring confined by a rigid auxiliary ring it will be understood that the auxiliary ring may constitute a split ring or two rings constituting the outermost ring and an innermost ring and illustrations of this type of embodiment are shown in FIGS. 7–9 inclusive.

As illustrated in FIG. 7 an inner ring 73 is provided with longitudinal grooves 74, 75. A pair of outer rings 76, 77 are provided with respective tongues 76*a*, 77*a* received in the grooves of the inner or center ring 73. Thus, in this case an innermost ring 73 is provided and deformation of the elastic, deformable body of the inner ring 73 is precluded inwardly and outwardly. The surfaces defining the thickness of the inner gasket are tapered and can have a considerable amount of pressure applied thereto to effect a waterproof seal.

Another embodiment of the ring gasket is illustrated in FIG. 8 in which an inner elastic deformable ring 87 has a rigid outer ring 88 disposed in a notch or shoulder 89 thereof. In this instance the sealing surfaces are tapered somewhat similar to the embodiment illustrated in FIG. 7.

A split-ring type of ring seal can be used in watchcases in the positions illustrated with respect to the watchcases according to the invention. For example, such a watchcase is shown in FIG. 9 in which an inner watchcase band 92 supports a watch dial 93 and an outer watchcase band 95 clamps a bezel 98 onto a composite ring gasket 99. The ring gasket 99 is of the type illustrated in FIG. 7, however, the deformable ring thereof has sealing surfaces which are arcuate in cross-section. Thus a flat underside surface of the bezel and the flat top surface of the watchcase 92 effects a waterproof seal with the ring gasket 99.

What is claimed is:

1. A watch glass ring gasket comprising an inner ring gasket made of an elastic, deformable material for effecting a watertight seal in a watchcase, an auxiliary ring comprising an outer ring of rigid material circumferentially of the inner ring limiting outward deformation of the inner ring, the outer ring having a lesser thickness than the inner ring and having an upstanding projection insertable into a recess in a member cooperative with said inner ring gasket in effecting a fluid-tight seal therewith and releasably locking said ring gasket in position relative to a surface sealed by the inner ring, the inner ring having oppositely disposed sealing surface portions defining the thickness dimension thereof.

2. A waterproof watchcase comprising, a watchcase band within which watchworks can be disposed, a watch crystal held on said band, said band and cyrstal having flat surfaces opposite one another, and a ring gasket effecting a fluid-tight seal between said surfaces of the watch crystal and said watchcase band, said ring gasket comprising an inner ring gasket of an elastic, deformable material for effecting said seal and auxiliary ring means comprising an outer ring of a rigid material disposed circumferentially of the inner ring, secured thereto, limiting the deformation outwardly of said inner ring, the outer ring being disposed between said surfaces and having a lesser thickness than the inner ring, and the inner ring having oppositely disposed sealing surfaces defining the thickness thereof.

3. A waterproof watchcase according to claim 2, in which said auxiliary ring means comprises said outer ring and in innermost ring disposed interiorly of said elastic inner ring, secured thereto and limiting its deformation inwardly, and said innermost ring having a lesser thickness than said thickness defined by said sealing surfaces.

4. A waterproof watchcase according to claim 2, also including an auxiliary innermost rigid ring disposed interiorly of and secured to said elastic inner ring limiting inward deformation of the inner ring, and said innermost ring having a lesser thickness than said thickness defined by said sealing surfaces.

5. A waterproof watch case according to claim 2, in which said auxiliary ring means includes an arcuate member deforming the inner ring along said arcuate member.

* * * * *